United States Patent [19]

Pike

[11] 4,143,601

[45] Mar. 13, 1979

[54] FOLDABLE TABLES

[76] Inventor: Robert H. Pike, 403 Pitkin St., Ft. Collins, Colo. 80521

[21] Appl. No.: 678,687

[22] Filed: Apr. 20, 1976

[51] Int. Cl.[2] ..... A47B 3/087

[52] U.S. Cl. ..... 108/35; 108/129

[58] Field of Search ..... 108/35, 36, 34, 129, 108/131, 132; 248/188.8, 188.9

[56] References Cited

U.S. PATENT DOCUMENTS

| | | | |
|---|---|---|---|
| 939,824 | 11/1909 | Forbes et al. | 108/129 X |
| 1,063,642 | 6/1913 | Birdsall | 108/36 |
| 1,446,917 | 2/1923 | McGrew | 108/36 |
| 1,571,807 | 2/1926 | Schmitt | 108/132 |
| 2,071,928 | 2/1937 | Golden | 108/129 |
| 2,115,727 | 5/1938 | Lenz | 108/129 |
| 2,167,342 | 7/1939 | York | 108/35 |
| 2,715,558 | 8/1955 | Bell | 108/129 X |
| 2,775,153 | 7/1956 | Pucci et al. | 108/35 |
| 2,969,249 | 1/1961 | Fox | 108/131 X |

*Primary Examiner*—Roy D. Frazier
*Attorney, Agent, or Firm*—Hugh H. Drake

[57] ABSTRACT

A foldable table has a pair of top sections hinged together along mating edges and with each top section including a top panel together with a peripheral skirt. A pair of legs are pivotally mounted respectively near the outer corners of each top section and are swingable between a downwardly-projecting support position and a folded position. Adjustable ties are angled respectively between different ones of the legs and the top sections for rigidifying the legs when in the support position. Each leg is pivotally mounted to swing widthwise of the table. A plurality of struts are each angled lengthwise of the table between a portion of the leg and a corresponding portion of the related top section, each strut being respectively coupled at each end to swing with its associated leg between the support and folded positions. In addition, means are provided for locking the legs in the support position.

1 Claim, 20 Drawing Figures

22'
24'
42'
75'
90'
53'
40'
74'
44'
46'
52'
66
16
17
19
36'
50'
72'
73'
51'
38'
14
13
100

FOLDABLE TABLES

The present invention pertains to foldable tables. More particularly, it relates to a type of table which is both readily portable and yet exhibits very substantial supporting strength.

For both portability and convenience of storage, it is known to construct tables so as to be foldable into a comparatively compact package. So-called picnic tables are a common example. In those and other tables, it is known to provide a variety of means for folding or collapsing the legs of the table when the table is not in use. The ordinary card table is an example of that approach.

At lease most such tables include some kind of adjustable ties or bracing between the foldable or collapsible legs and the table top. These arrangements often include a lockable scissors-type brace, a telescoping strut, cooperating pivotal connections and the inclusion of reinforcement members at various points. Obviously, these prior tables have proved to be very useful. Most households have one or more that often are used either for indoor or outdoor activities. At least in common experience, however, one well understood admonition is a rule against anyone choosing to sit on the table. Those of the usual household kind simply will not ordinarily support that kind of weight.

Of course, portable-type tables have been designed for use in connection with industrial applications wherein substantial weights are accommodated. These typically feature removable legs and structural members that not only are strong but also result in quite heavy weight of the overall assembly. In short, the latter are in a completely different weight class, usually requiring at least two persons for the purpose of their handling in transport and assembly.

Contrasting the kinds of tables discussed above, there seems to be one group which is capable of being folded into a compact storage assembly and is reasonably light in weight. However, tables in this group are not capable of withstanding the imposition of very heavy weight or movement of a heavy weight when implaced upon their tops. Of course, industrial-type tables constitute a second group capable of accommodating such loads, but that type of table in itself tends to be too heavy and cumbersome.

It is, accordingly, a general object of the present invention to provide an improved foldable table which overcomes deficiencies and disadvantages in foldable tables of the kinds adverted to hereinabove.

Another object of the present invention is to provide an improved foldable table which tends to achieve the aims of being both light in weight in itself, capable of compact foldability for storage or transportation and yet capable of supporting large and mobile loads.

A field of use particularly adaptable to the introduction of a suitable foldable table is that which involves the administration of preventive services or treatment to athletes by a trainer or physician. Of course, such a person seeking to aid an athlete requires a place of repose for that athlete that is both a firm support and of proper height and other dimensions. Because of inadequacy of facilities often found, particularly in such places as visiting locker rooms, the desire for a suitable portable or foldable table becomes apparent. Yet, such a table not only must be capable of ready storage and transport but must also exhibit sufficient strength and durability as to adequately support, for example, a two-hundred-eighty pound football lineman in full equipment and who may not be very "delicate" in the manner in which he mounts and dismounts from the table. Up to now, it appears that only the aformentioned industrial-type tables might suffice. However, they are in themselves so heavy and awkward as to be unjustified for ths type of usage.

In view of the foregoing, it is a still further object of the present invention provide an improved foldable table which meets and satisfies the deficiencies as adverted to immediately above.

The invention thus pertains to a foldable table that has a pair of top sections hinged together along mating edge portions, each top section including a top panel and a peripheral skirt. A pair of legs pivotally mounted respectively near the outer corners of each top section are swingable between a downwardly-projecting support position and a folded position within the respective skirt. Adjustable ties are angled respectively between different ones of the legs and the top sections for rigidifying the legs when in the support position. As improved, the table further includes means for pivotally mounting each of the legs to swing widthwise of the table between the support and folded positions. A plurality of struts are each angled lengthwise of the table between a portion of a leg and a corresponding portion of the related top section. Each strut is respectively coupled at each end to swing with its associated leg between the support and folded positions. Also included are means for locking the legs in the support position. The latter means includes respective braces angled widthwise of the table between a portion of each leg and a corresponding portion of the related top section. Each of the ties mentioned above is in the form of an elongated rigid rod, there is a pivotal coupling at one end of each rod to the corresponding leg, and a removable coupling at the other end of each leg defines a fastener that is secure and rigid.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
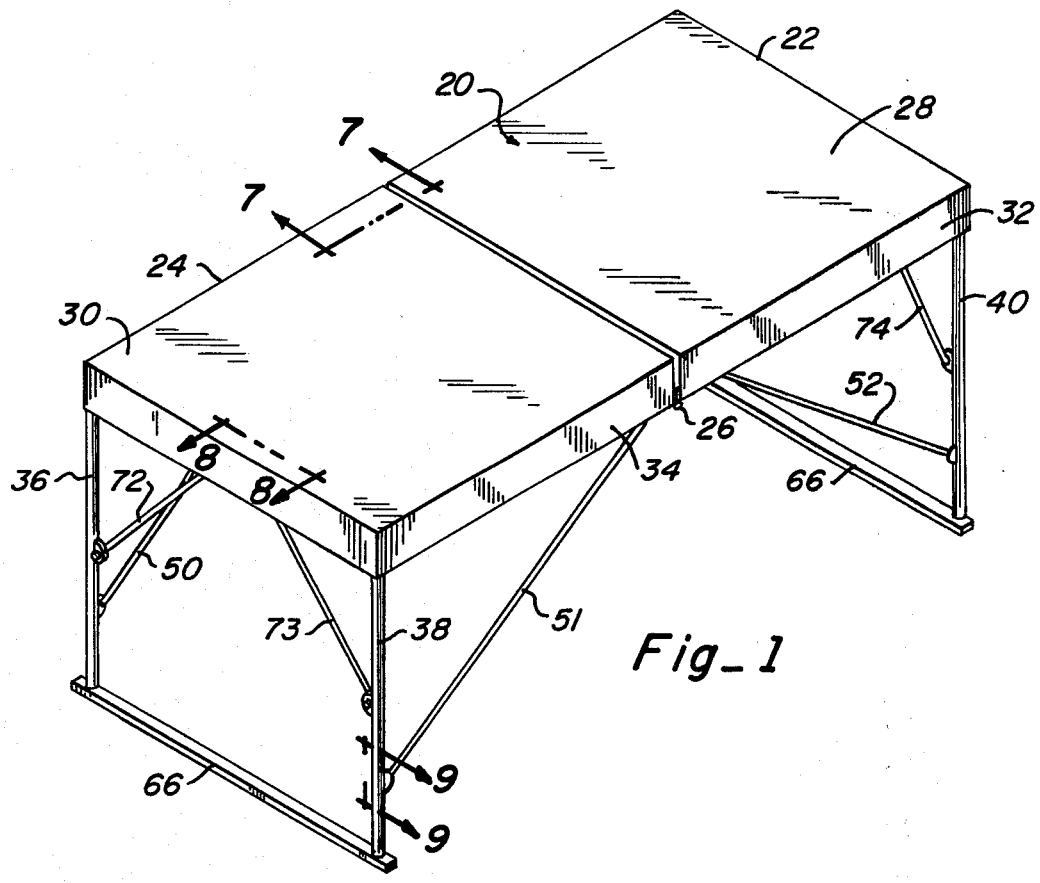
FIG. 1 is a perspective view of one form of a foldable table in its working position.

FIGS. 1-11 depict a first version of a foldable table. Figures 12—20 pertain to an alternative preferred version. Primes are used in the numbering of parts of the second version that have functions essentially the same as correspondingly-numbered parts of the first version.

A foldable table 20 has a pair of top sections 22 and 24 joined together by a piano-type hinge 26 along mating edge portions. Each top section includes a respective top panel 28 and 30 together with a corresponding peripheral skirt 32 and 34. As shown specifically in the case of the second version, the lower skirt margins preferably are in-turned. A pair of legs 36 an 38 ae pivotally mounted respectively near the outer corners of top section 24, and another pair of legs 40 and 42 similarly are pivotally mounted near the outer corners of top section 22. Each of legs 36-42 is so mounted as to be swingable between a downwardly-projecting support position and a folded position within the respective ones of skirts 32 and 34.

Each of legs 36-42 is mounted to swing widthwise of table 20 between its support and folded positions. With legs of circular cross section as specifically illustrated in FIGS. 1-11, FIG. 6 details the pivotal connection of leg 42 by a pin 44 secured at its opposite ends in a bracket 46 affixed inside the corresponding corner of skirt 32. Analogously for the modified version of FIGS. 12-20, leg 40', of square cross section, is secured by a pin 44' within a bracket 46' affixed to the inner wall and near a corner of skirt 32'.

Figure 7:
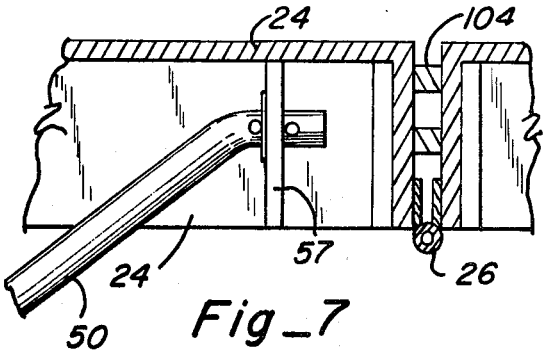
FIG. 7 is a fragmentary and enlarged cross-sectional view taken along the line 7—7 in FIG. 1.
Figures 12, 13, 14, 15:
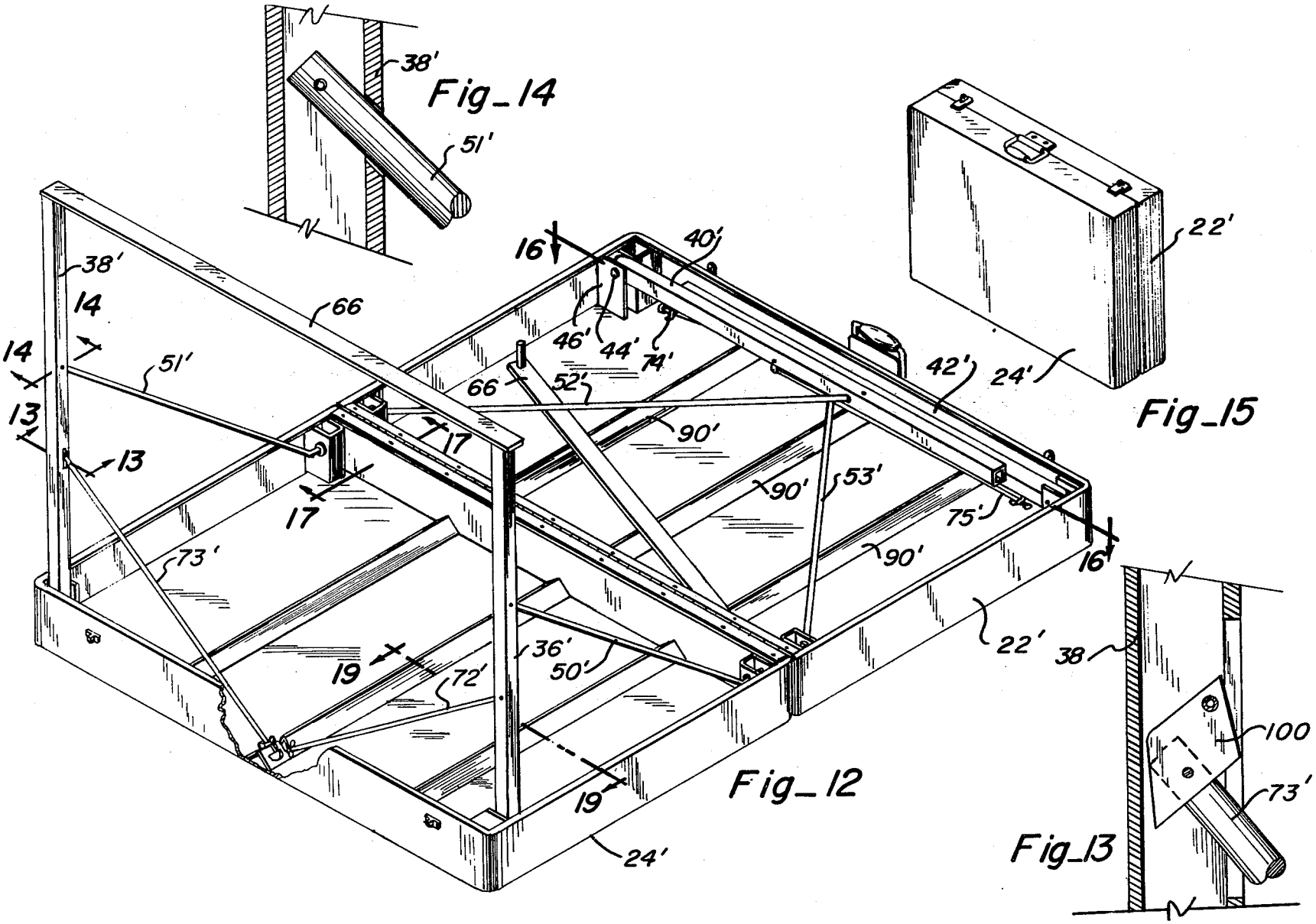
FIG. 12 is a bottom perspective view of a partially folded table similar to the one shown in FIG. 1 but incorporating a modification of parts.
FIG. 13 is a fragmentary and enlarged cross-sectional view taken along the line 13—13 in FIG. 12.
FIG. 14 is a fragmentary and enlarged cross-sectional view taken along the line 14—14 in FIG. 12.
FIG. 15 is a reduced perspective view showing the table of FIG. 12 in a fully folded condition.
Figure 16:
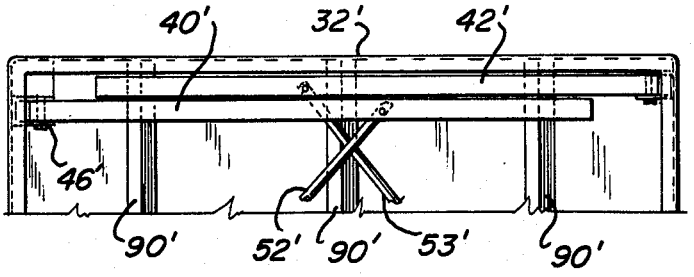
FIG. 16 is a fragmentary cross-sectional view taken along the line 16—16 in FIG. 12.
Figure 17:
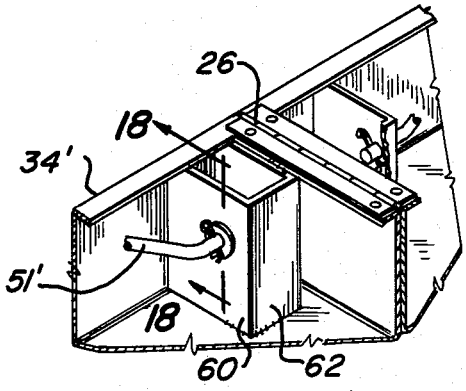
FIG. 17 is an enlarged fragmentary cross-sectional view taken along the line 17—17 in FIG. 12.
Figure 18:
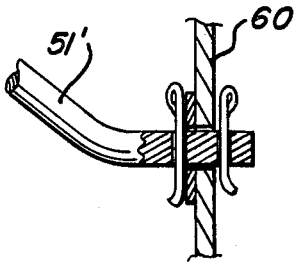
FIG. 18 is a fragmentary cross-sectional view of a detailed portion of FIG. 17 and taken along the line 18—18 in FIG. 17.

Adjustable ties are angled respectively between different ones of the legs and the top sections for rigidifying the legs when in their support positions. To that end, a plurality of struts 50, 51, 52 and 53 are each angled lengthwise of table 20 between a portion of a respective leg 36-42 and a corresponding portion of the related top section 24 or 22. Each of struts 50-53 is respectively coupled at each end to swing with its associated leg between the support and folded positions of the latter. In more detail, each of struts 50-53 is rigidly connected at one end to the respective leg portion, as by welding at 55, and pivotally connected at its other end to the related top section. For example, FIG. 7 depicts how the upper end portion of strut 50 is bent to project through an aperture in one leg of a corner piece 57 that has its other leg secure to the inner wall of skirt 34 in a region of the latter near hinge 26. As indicated in the drawing, a pin may be inserted to additionally secure the strut in place. The analogous upper end portions of the other struts are similarly affixed at corresponding locations beneath the top panels. Analogous lengthwise struts are employed in the alternative embodiment of FIGS. 12-20. As shown in FIG. 14, a strut 51' is pinned at one end within leg 38' so as to establish a rigid connection. At its upper end as shown in FIG. 17, strut 51' is pivotally received in an aperture formed in one leg 60 of a U-shaped bracket 62 secured to the inner wall of skirt 34' adjacent to hinge 26. As revealed in FIG. 18, a washer and pins near the upper end of strut 51' serve to hold strut 51' in position. The corresponding other struts are similarly mounted.

A rigid cross bar 66 is affixed between the lower ends of each pair of legs respectively associated with each of the top sections. At least the lower end portion of each of the legs is hollow cored as shown at 68 in FIG. 4. Projecting upwardly from cross bar 66 are corresponding stubs 70 that are received within the respective ones of those lower end portions 68. Thus, cross bars 66 serve to lock the corresponding legs in the support position of the latter.

Figure 8:
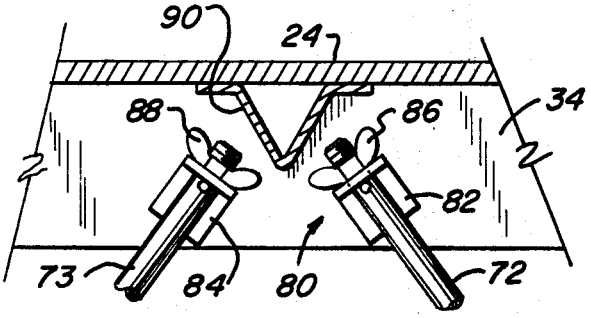
FIG. 8 is a fragmentary and enlarged cross-sectional view taken along the line 8—8 in FIG. 1.
Figure 9:
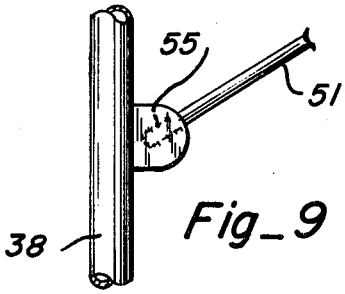
FIG. 9 is a fragmentary and enlarged cross-sectional view taken along the line 9—9 in FIG. 1.
Figure 10:
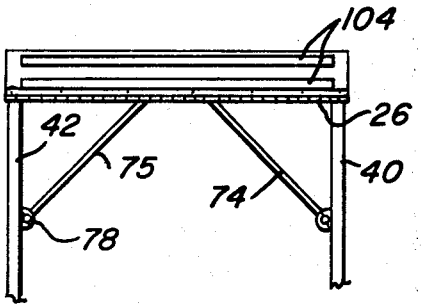
FIG. 10 is a fragmentary cross-sectional view taken along the line 10—10 in FIG. 2.

Respective braces 72, 73, 74 and 75 are angled widthwise of table 20 between a portion of corresponding ones of each leg 36, 38, 40 and 42 and a corresponding portion of the related one of top sections 22 and 24. Each of braces 72-75 is pivotally coupled at one end and detachable coupled at the other end to enable swinging of its associated leg between the support and folded position of the latter. More particularly, each brace is pivotally coupled to a portion of its associated leg, as at 78 in FIG. 3, and is detachably coupled to the top section as at 80. Each of braces 72-75 is of a length to accommodate its being nested within the respective top section skirt along with the corresponding leg when the latter is in its folded position. As shown in FIG. 8, for the embodiment first set forth in the drawings, the upper end portion of each of braces 72 and 73 is secured within a slot provided in one leg of respective corner brackets 82 and 84 by means of suitable wing nuts 86 and 88. The other legs of brackets 82 and 84 are secured as by welding to the inner surfaces of the adjacent portion of the skirt of the top section.

Figure 19:
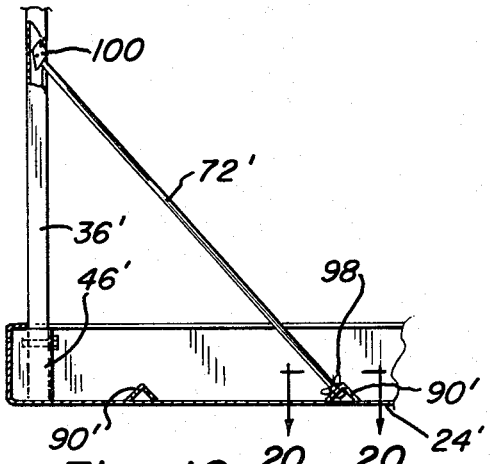
FIG. 19 is a fragmentary cross-sectional view taken along the line 19—19 in FIG. 12 and with certain of the parts omitted.
Figure 20:
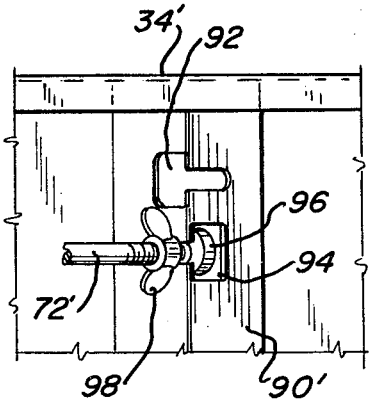
FIG. 20 is a fragmentary cross-sectional view taken along the line 20—20 in FIG. 19.

Both of the principal embodiments preferably include laterally spaced reinforcing elements that are secured to and run lengthwise along the underside of the respective ones of top panels 28 and 30. Those reinforcing elements here take the form of V-bars 90 or 90'. As shown particularly in FIGS. 12, 19 and 20, a longitudinally-adjacent spaced pair of T-notches 92 and 94 are formed at each end near the apex of the central one of V-bars 90' for the purpose of receiving the upper ends of the corresponding ones of the braces. Thus, the upper end of brace 72' has a transverse collar 96 that fits into the cross-top of the "Tee" and is secured within the blade of the Tee by means of a wing nut 98. The other ones of the end braces are similarly secured at their upper ends in the embodiment of FIGS. 12-20. Also with regard to this second of the two illustrated embodiments, the lower end of each endwise brace, as shown in FIGS. 13 and 19, is secured for pivotal movement to a swingable block 100 pinned within the interior of the associated leg behind an opening permitting swingable entry of the leg itself. Again, the corresponding other legs and braces are similarly constructed.

Figure 2:
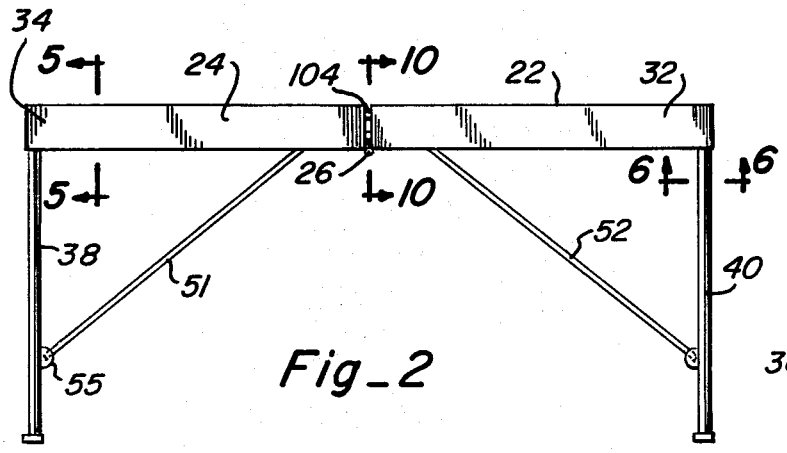
FIG. 2 is a side-elevational view of the table shown in FIG. 1.
Figure 3:
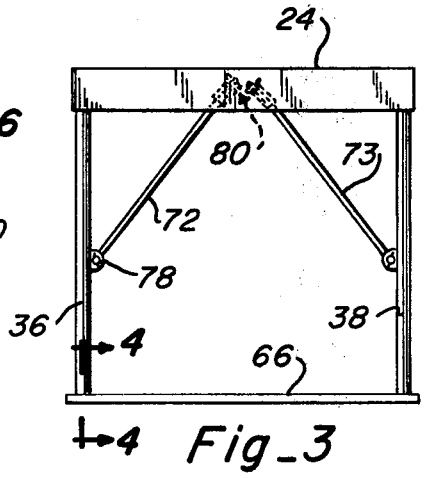
FIG. 3 is an end-elevational view of the table shown in FIG. 1.
Figure 4:
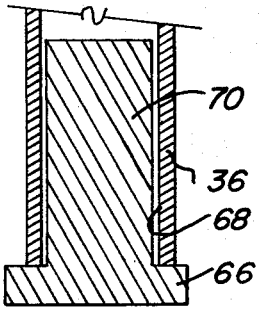
FIG. 4 is a fragmentary cross-sectional view taken along the line 4—4 in FIG. 3.
Figure 5:
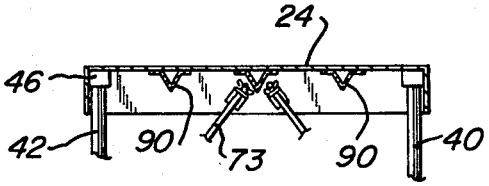
FIG. 5 is a fragmentary cross-sectional view taken along the line 5—5 in FIG. 2.
Figure 6:
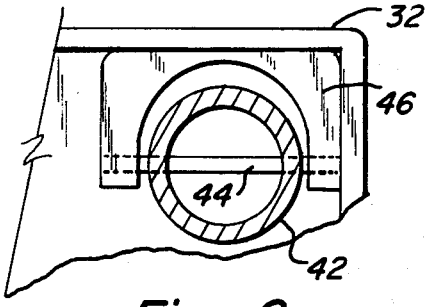
FIG. 6 is a fragmentary and enlarged cross-sectional view taken along the line 6—6 in FIG. 2.

As shown particularly in FIGS. 2 and 7, the facing portions of skirts 32 and 34 are spaced apart by a predetermined distance. Widthwise bars 104 are secured to at least one of the facing portions and project toward the other by an amount slightly greater than that distance of spacing between the two skirts. This adds rigidity to the table top as it is folded out into its in-use position.

Figure 11:
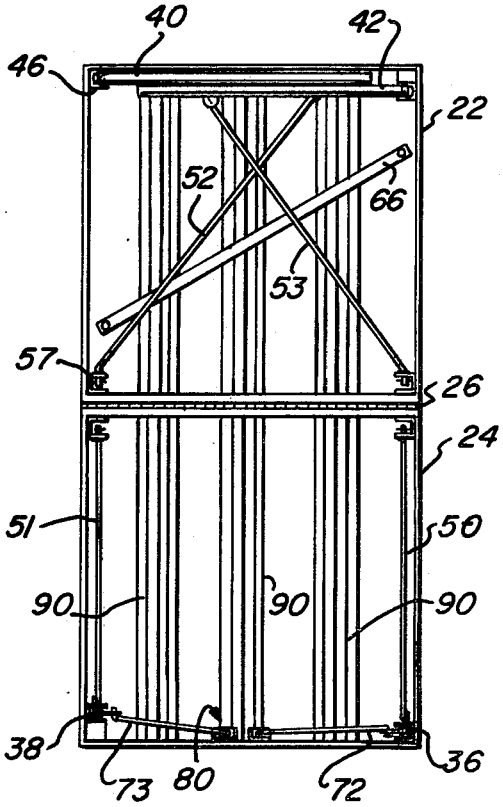
FIG. 11 is a bottom view of the table of FIG. 1 with certain of the parts in different positions.

The illustration of the two different embodiments is intended to be complemental. For example, it is to be understood that the embodiment of FIGS. 1–11 folds up into its storage position in the manner specifically shown in FIG. 15 for the second embodiment. FIGS. 11 and 12 illustrate respective partially-folded states. Most of the basic functions are the same as between the two embodiments and it is also to be understood that any specific features of the first embodiment may be substituted in the second or vice versa. In general, all parts preferably are fabricated of aluminum. In one version of the first embodiment that utilized 40-guage aluminum for the top panels and the peripheral skirts, the weight of the total assembly was only 18 pounds. Even in a greatly-strengthened version constructed in accordance with the second embodiment and utilizing 80-guage panels, the total weight still was only 38 pounds. In either case, the resultant unit folded into a sufficiently compact storage position as to be transportable in the back seat of an ordinary passenger vehicle; yet, it served most adequately to support the mounting, dismounting and treating of large numbers of heavy athletes.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In a foldable table having a pair of top sections hinged together along mating edge portions, each top section including a top panel and a peripheral skirt, a pair of legs pivotally mounted respectively adjacent to the outer corners of each top section and swingable between a downwardly-projecting support position and a folded position within the respective skirt, and means for pivotally mounting each of said legs to swing widthwise of said table between said support and folded positions;

individual ties angled respectively between different ones of said legs and said top sections and disposed widthwise for rigidifying said legs when in said support position, a plurality of struts each angled lengthwise of said table between a portion of a leg and a corresponding portion of a related top section, each said strut being respectively coupled fixedly in place at each end to swing with its associated leg between said support and folded positions;

the improvement comprising:

each of said ties being in the form of an elongated rigid rod;

means defined at one end of each of said rods for pivotally coupling said one end to the corresponding one of said legs;

means formed on the other end of each of said rods for defining a first part of a removable coupling;

means secured rigidly on the underside of said top sections adjacent to the outer margins thereof, opposite said mating edge portions, for defining a second part of said coupling fastenable to said first part in secure rigid mutual interrelationship;

a laterally-spaced plurality of reenforcing elements secured to the underside of respective ones of said top panels;

and means including in said reenforcing elements respectively defining each of said second parts.

* * * * *